US007533846B2

(12) United States Patent
Sellars et al.

(10) Patent No.: US 7,533,846 B2
(45) Date of Patent: May 19, 2009

(54) TOWEL ROLL PRODUCT WITH SUPPORTIVE, PROTECTIVE WRAPPER

(75) Inventors: John C. Sellars, Wauwatosa, WI (US); Jerry Ballas, Media, PA (US); Neal D. Watson, Fox Point, WI (US)

(73) Assignee: Sellars Absorbent Materials, Inc., Milwaukee, WI (US)

( * ) Notice: Subject to any disclaimer, the term of this patent is extended or adjusted under 35 U.S.C. 154(b) by 18 days.

(21) Appl. No.: 11/738,880

(22) Filed: Apr. 23, 2007

(65) Prior Publication Data

US 2008/0017750 A1 Jan. 24, 2008

Related U.S. Application Data

(60) Provisional application No. 60/793,751, filed on Apr. 21, 2006.

(51) Int. Cl.
*B65H 75/18* (2006.01)

(52) U.S. Cl. ..... 242/593; 242/588; 206/389; 206/409

(58) Field of Classification Search ..... 242/593, 242/588, 588.2, 588.3, 405, 405.3, 160.1, 242/160.3, 160.4; 206/389, 397, 398, 400, 206/402, 409, 410; D6/521–523
See application file for complete search history.

(56) References Cited

U.S. PATENT DOCUMENTS 4,002,264 A * 1/1977 Marchesani ..... 206/409
4,535,912 A * 8/1985 Bonk ..... 206/409
5,595,786 A * 1/1997 McBride et al. ..... 206/494
5,803,249 A * 9/1998 Harsanyi et al. ..... 206/233
6,220,435 B1 * 4/2001 Nobile et al. ..... 206/409
6,607,514 B2 * 8/2003 Reese ..... 206/210
6,779,662 B2 * 8/2004 Dorsey ..... 206/410
6,840,401 B2 * 1/2005 Amundson ..... 206/494
D504,794 S * 5/2005 Sellars ..... D6/522
2002/0148748 A1 * 10/2002 Pikul ..... 206/409
2004/0251292 A1 * 12/2004 Grebonval et al. ..... 206/409
2007/0163909 A1 * 7/2007 Ice ..... 206/410

* cited by examiner

*Primary Examiner*—William A Rivera
(74) *Attorney, Agent, or Firm*—Fredrickson & Byron, PA

(57) ABSTRACT

A generally cylindrical towel roll product comprises an absorbent towel roll having an upright axis, and a flexible, water resistant, protective wrapper engaging the circumferential surface of the towel roll and of sufficient strength to restrain significant diametric expansion of the towel roll when the roll is subjected to an axial load and to increase axial stiffness of the product. The wrapper includes top and bottom portions that encase the top and bottom surfaces of the roll, respectively, the top wrapper portion having an opening providing axial access to the towel roll and through which individual towels can be drawn axially from the interior of the towel roll. A removable and replaceable soil and water-resistant cover protectively covers the wrapper opening, and a rigid disc may be provided between the top surface of the towel roll and the top portion of the wrapper, the disc extending radially to the periphery of the upper surface of the roll.

15 Claims, 6 Drawing Sheets

TOWEL ROLL PRODUCT WITH SUPPORTIVE, PROTECTIVE WRAPPER

RELATED APPLICATION

This application claims priority to U.S. Provisional Patent Application No. 60/793,751 filed Apr. 21, 2006, the teachings of which are incorporated herein by reference.

BACKGROUND

Disposable absorbent wipers/towels have many uses. Disposable wipers/towels are particularly popular with do-it-yourself homeowners and trades people who find wipers valuable for cleaning tools, work areas and their hands. Disposable wipers are also used frequently in factories, on farms and in the boating industry (both commercial and recreational). These are just a few of the wide variety of people and multitude of uses of disposable wipers. Frequently, disposable wipers are used by people who are on the go, whether it be trades people moving from job to job, maintenance people moving from machine to machine within a factory or farmers dealing with issues wherever they come up. Containers of disposable wipers thus are often treated as valuable items of one's normal equipment for performing jobs and are often carried in the back of trucks to job sites along with other tools or on maintenance carts in factories. Disposable wiper containers end up in countless types of places, wherever people do work.

Often, because these containers can be used and stored outside, they can become exposed to inclement weather or they can be indoors in dusty and dirty environments. Traditionally, disposable wipers have been packaged in cardboard boxes, the wipers being dispensed through an open hole in the top.

For convenience, absorbent towels commonly are provided as successive sheets on a continuous web wound in roll form with individual sheets separable from the roll by means of perforation lines established at pre-determined distances. The towels are commonly drawn from the interior of the roll, and the perforations allow a user to tear off a portion of the absorbent towel roll. Rolls of toweling may be housed in dispensers, such as cardboard boxes, that allow the user to access the towels, usually through a small opening provided in the top of the box.

A challenge associated with dispensing absorbent towels involves the ability to protect the towels from contaminants such as dirt and water so that on the one hand the effectiveness of the towels is not compromised and on the other hand the towels can be easily accessed by a user. Cardboard box dispensers of the type currently available from Kimberly-Clark Corporation under its "Rags in a Box" trademark, can become water or oil soaked if exposed to the elements or placed on a wet or oily support, resulting in towels within the dispenser becoming contaminated with water or oily residue. Cardboard boxes themselves are susceptible to degradation, especially upon becoming wet. When towels within a box become water-soaked, dirty or oily, they become substantially useless and are discarded.

A solution to this problem is disclosed in U.S. patent application Ser. No. 10/870,329, published as publication number 20050046314, the entire contents of which are incorporated by reference herein. That application discloses a water-resistant container having bottom, top and side walls and having a manually graspable exterior handle. A roll of dry, disposable towels is carried within the container, the top wall being vertically movable, upon application of an exterior force, to enable it to be depressed against and supported by the towel roll. An opening in the top wall of the container provides finger access to towels in the interior of the container, the towels being drawn from the container from the interior of the roll of towels.

The container thus described works very well for its intended purpose. However, once the roll of towels has been exhausted, a fresh roll of towels must be inserted in the container, and this may require an inventory of replacement or refill towel rolls to be maintained at or near the job site. It may often be inconvenient to provide a dry and clean storage space for towel rolls. When a supply of replacement towel rolls is not appropriately protected, as, for example, by being stored in containers of the type described above, the supply of rolls may easily become wet or soiled. Moreover, in order for individual towel sheets to be drawn from a replacement towel roll, the roll must somehow be supported, as by placing it in the container.

It would be desirable to provide replacement towels in a form in which they are protected from the elements so that they may be stored in less than clean environments without harm to the towels. It would be particularly desirable to provide a towel roll product in a form in which the towel roll is itself protected from the elements, the product enabling individual towels to be removed from the roll interior without the necessity of placing the towel roll in the container referred to above.

BRIEF SUMMARY OF THE INVENTION

As described herein, the terms "upper", "lower", "top", "bottom", "upright" and other descriptors of direction and position have been used for convenience in describing a towel roll product in which the axis of the roll is upright or vertical and individual towel sheets are drawn upwardly from the center of the roll.

The invention relates to a generally cylindrical towel roll product that comprises an absorbent towel roll encased in a flexible, water resistant, desirably single thickness wrapper that protects the toweling and that serves to maintain the generally cylindrical shape of the towel roll.

The generally cylindrical towel roll product is portable and water resistant, and provides toweling in a convenient roll form for use either by itself as a towel source protected and supported by a wrapper, or as a replacement or refill for use in a protective, water-resistant container having bottom, top and side walls and having a manually graspable exterior handle. The wrapper desirably tightly encases the circumferential surface of the towel roll to increase axial stiffness of the product, and includes top and bottom portions that encase the top and bottom surfaces of the roll, respectively.

The wrapper, which otherwise desirably covers and protects the entire roll, has an opening in its upper portion providing access to the towel roll and through which individual towels can be drawn axially from the interior of the towel roll. A removable soil and water-resistant cover is provided to cover the opening when the product is not being used. A rigid disc having a central towel-access opening aligned with the opening in the upper wrapper portion may be provided between the top surface of the roll and the top portion of the wrapper, the disc extending radially outwardly from the towel access opening and desirably extending to the periphery of the top surface of the roll, preferably being coextensive with the top surface of the roll. The towel roll product thus provides a cost-effective, light weight protective towel dispensing system. The circumferentially extending wrapper restrains distortion, that is, expansion of the diameter, of the towel roll when the roll is subjected to an axial load, as when several rolls are stacked vertically. The towel roll may include an optional sheet extending about a major portion of the circumference of the roll. The sheet, which may take the form of a label that is visible through the wrapper, may also contribute to axial stiffness of the roll.

In one embodiment, the present invention provides a generally cylindrical towel roll product comprising an absorbent towel roll having an upright axis, a circumferential outer surface and top and bottom surfaces, and a flexible, water resistant, protective wrapper engaging the circumferential surface of the towel roll (including, of course, any sheet-like label placed against the roll) about its entire circumference. The wrapper is of sufficient strength to restrain significant diametric expansion of the towel roll when the roll is subjected to an axial load, and increases axial stiffness of the product. The wrapper includes top and bottom portions that encase the top and bottom surfaces of the roll, respectively, the top wrapper portion having an opening providing axial access to the towel roll and through which individual towels can be drawn axially from the interior of the towel roll. The wrapper has a removable and replaceable soil and water-resistant cover protectively covering the wrapper opening.

In another embodiment, the invention provides a towel product comprising a container and an absorbent towel roll product housed in the container. The towel roll product includes a generally cylindrical towel roll having an upright axis, a circumferential outer surface and top and bottom surfaces. A flexible, water resistant, protective wrapper engages the circumferential surface of the towel roll about its entire circumference, the wrapper being of sufficient strength to restrain significant diametric expansion of the towel roll when the roll is subjected to an axial load. The wrapper includes top and bottom portions that encase the top and bottom surfaces of the roll, respectively, the top wrapper portion having an opening providing axial access to the towel roll and through which individual towels can be drawn axially from the interior of the towel roll. The towel roll product is housed within a protective, water-resistant container having bottom, top and side walls and a manually graspable exterior handle, the top of said container having an opening providing axial access to the towel roll and a hinged lid providing axial access to the container opening.

The embodiments thus described desirably also include a rigid disc having a central towel-access opening aligned with the opening in the upper wrapper portion and positioned between the top surface of the roll and the top portion of the wrapper, the disc extending radially outwardly from the towel access opening.

In yet another embodiment, the invention provides a generally cylindrical towel roll product comprising an absorbent towel roll having an upright axis, a circumferential outer surface and top and bottom surfaces. The product includes a flexible, transparent, water resistant, protective wrapper tightly engaging the circumferential surface of the towel roll about its circumference, the wrapper being of sufficient strength to restrain significant diametric expansion of the towel roll when the roll is subjected to an axial load and to increase axial stiffness of the towel roll product. The wrapper has top and bottom portions that encase the top and bottom surfaces of the roll, respectively, the top wrapper portion having an opening providing axial access to the towel roll and through which individual towels can be drawn axially from the interior of the towel roll. A rigid disc is positioned between the upper surface of the towel roll and the top wrapper portion, the disc having an opening aligned with the opening in the upper portion of the wrapper to enable access to toweling, the disc extending radially outward to the periphery of the upper surface of the towel roll. A removable and replaceable soil and water-resistant cover protectively covers the wrapper opening.

DETAILED DESCRIPTION

The following detailed description should be read with reference to the drawings, in which like elements in different drawings are numbered identically. The drawings depict exemplary embodiments and are not intended to limit the scope of the invention.

Figure 1:
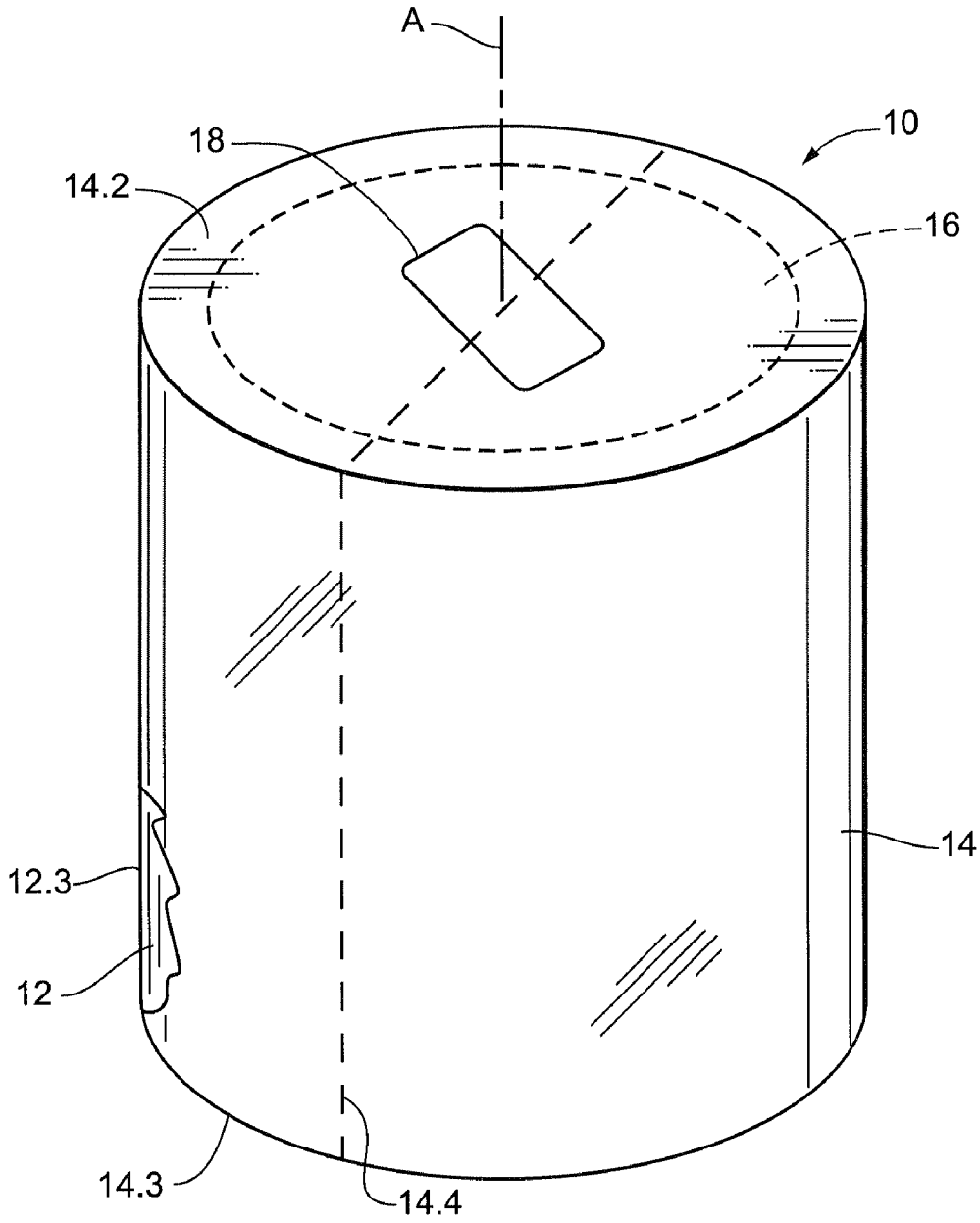
FIG. 1 is a perspective view, partially broken away, of an embodiment of a towel roll product of the invention.

Referring first to FIG. 1, a generally cylindrical towel roll product is shown at 10. A roll of absorbent toweling 12 is formed about an axis A, and is encased in an outer wrapper 14. For ease of understanding, the wrapper 14 is shown in the drawing as being transparent so that the roll of toweling can be seen through it, but it will be understood that the wrapper may be transparent, opaque, or of any particular color, and may bear an identification of the product, together with trademarks, advertising and the like.

Figure 2:
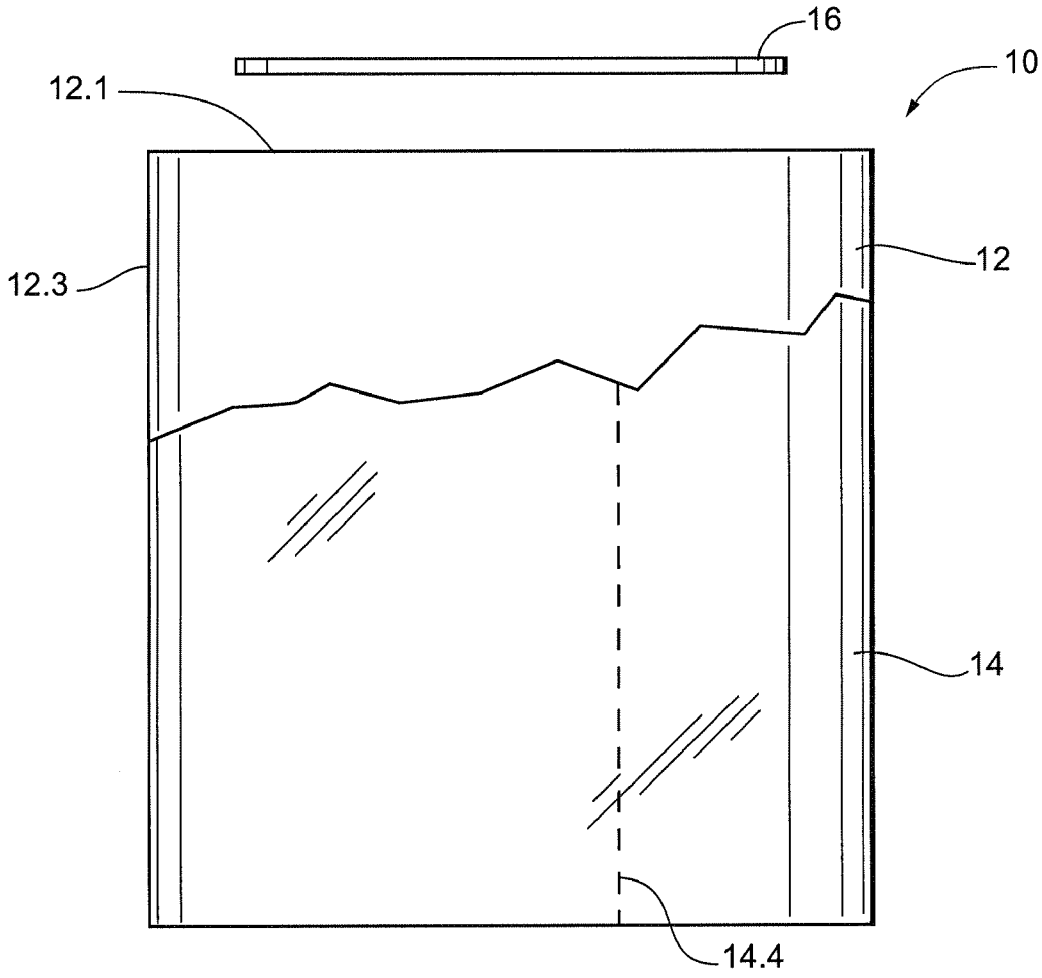
FIG. 2 is a partially exploded side view of a portion of the towel roll product of FIG. 1, with a portion broken away.
Figure 3:
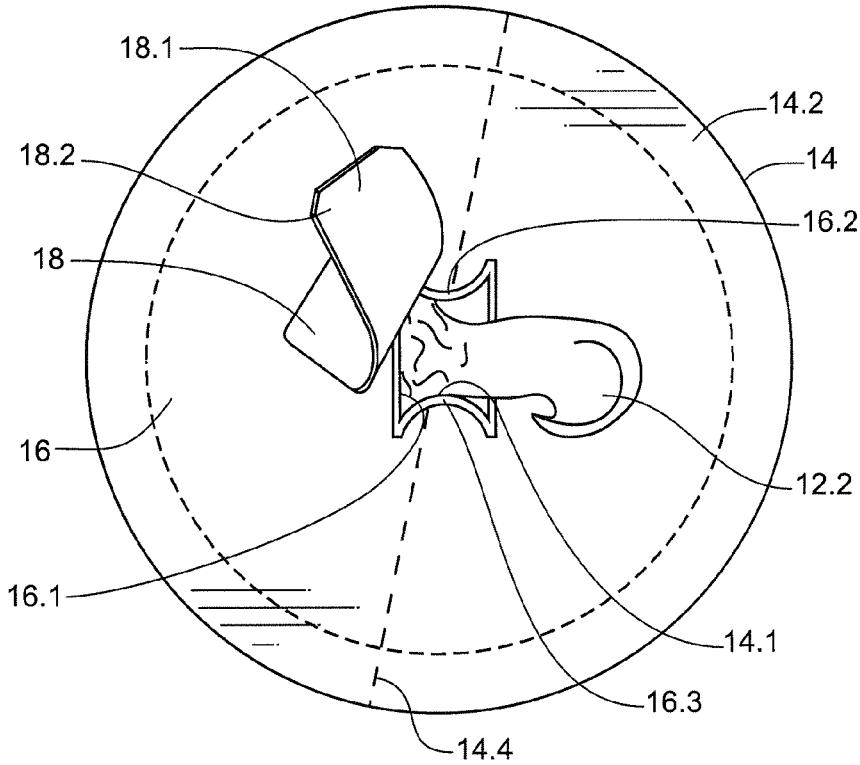
FIG. 3 is a top view of the towel roll product of FIG. 1, showing an opening through which towels may be drawn.
Figure 8:
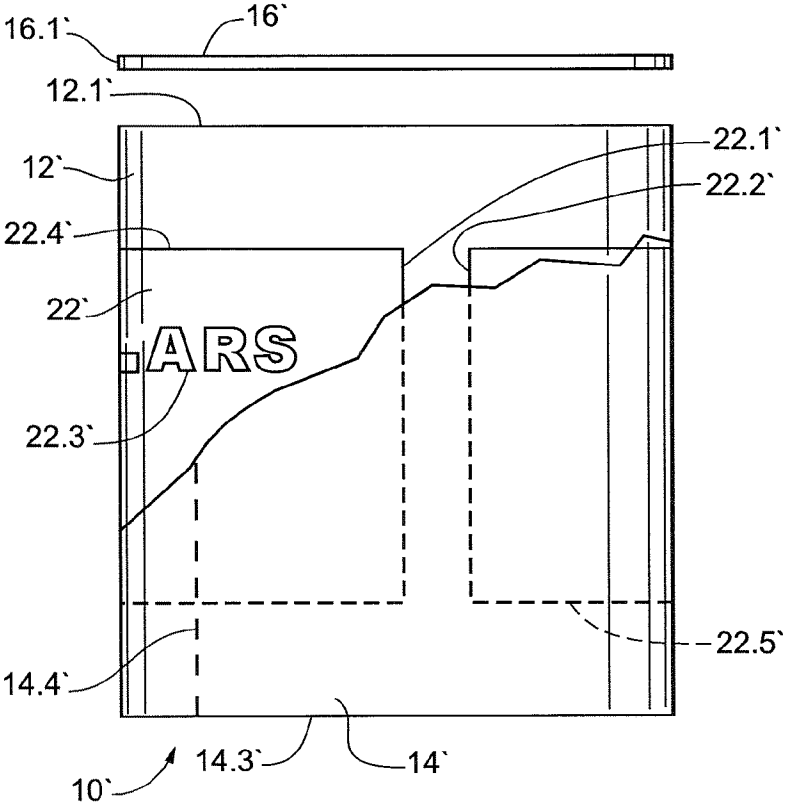
FIG. 8 is a partially exploded side view of a portion of the towel roll product of FIG. 7, with a portion broken away
Figure 7:
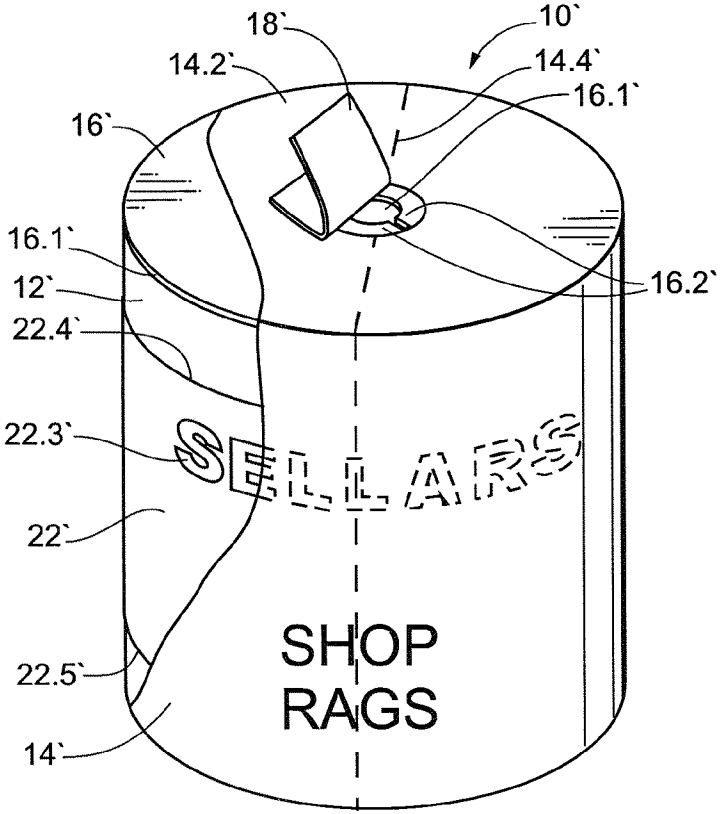
FIG. 7 is a perspective view, partially broken away, of a further embodiment of a towel roll product.

As shown in FIGS. 1 and 2, a disk 16 of rigid material (relative to the wrapper 14) is placed on the upper surface 12.1 of the towel roll. The disk may be made of any suitable material, cardboard being preferred for reasons of economy and weight, but the disk could be made of any appropriate material such as plastic, metal, stiff paper, etc. By "rigid" as used herein, we mean that the disc should be of sufficient rigidity as to spread downwardly directed axial loads across the upper surface of the towel roll, to withstand bending or tearing during use or storage of the product, and particularly to maintain its shape under radially inwardly directed forces tending to collapse the cylindrical shape of the product when much of the toweling has been removed. As shown in FIG. 3, the disk has a centrally positioned opening 16.1, and the wrapper 14 has a similarly positioned opening 14.1, the openings being aligned with the axis A of the roll and enabling toweling to be pulled axially through the openings from the interior of the roll. A section of toweling that protrudes from the openings is shown as 12.2 in FIG. 3. The disc may partially cover the upper surface of the towel roll, as shown in FIGS. 1 and 2, but preferably substantially covers, that is, extends to the periphery of the upper roll surface, as shown in FIGS. 7 and 8. The disc has a rounded periphery, and desirably is circular and is coextensive with the upper surface of the towel roll.

Covering the opening 14.1 (and thus also the opening 16.1) is a removable and resealable soil and water-resistant cover 18. Although the cover may be made of any suitable material, it preferably is provided in the form of a flexible plastic sheet having on all or a portion of the inner surface thereof (18.1 in FIG. 3) a releasable pressure-sensitive adhesive 18.2, the cover being capable of being peeled away from the upper surface of the wrapper 16.

The adhesive 18.2, for example, may be a repositionable pressure-sensitive adhesive enabling the cover to be repeatedly affixed and removed from the upper surface of the wrapper, and may be of the type employed in connection with the well-known 3M Post-It® products.

The toweling that is employed in the present invention can be any of a variety of well-known paper towel materials. Desirably, the toweling is of an absorbent material, and can be made from either a woven or non-woven material. There are a wide variety of non-woven processes, and they can be either wet laid dry laid. Some examples are hydroentangled materials (sometimes called "spunlace"), double re-creped materials, air laid materials, spunbond materials and meltblown materials, etc. "Toweling" is used herein, refers in general to sheet or web-like materials that may be absorbent and that may be provided in roll form. Sometimes referred to as "wipes" or "wipers," the toweling may have perforations (not shown) extending in lines across its width to separate individual toweling sheets and facilitate separation or tearing of individual sheets from the roll. Individual sheets may be sized as desired to accommodate the many uses of the towels. For example, perforation lines may be formed every 13 inches or so to define a universally-sized towel. Multiple perforation lines may be provided to allow the user to select the size of towel depending on the particular need. Although the toweling may be substantially dry, in some embodiments the toweling may be impregnated with and carry a liquid material such as a liquid soap, a wax, or a mild solvent or other cleaning or treating agent. The resulting moist towels may have a variety of uses such as cleaning, polishing, and the like.

The wrapper 14 engages and desirably tightly encases the circumferential surface 12.3 of the towel roll about its entire circumference, and has top and bottom portions 14.2, 14.3 that similarly preferably but not necessarily tightly encase as well as the top and bottom surfaces 12.1, 12.4 of the roll. The latter surface may be seen in FIG. 4 through the wrapper portion 14.3, which portion, for purposes of example only, is indicated as transparent. Desirably, the wrapper is a known heat shrinkable or stretchable polymeric film that also desirably can be heat-sealed. A biaxially oriented polyester film may be appropriate, and films of about 0.003 inches (about 0.76 mm) in thickness have given good results. A single thickness of the wrapper may be applied to a towel roll using known shrink packaging or stretch packaging techniques and equipment. In one embodiment, a film, e.g., polyester film approximately 3 mils (about 0.076 mm) in thickness is applied to the roll, the film being supplied in two sheets that then are heat sealed to each other about their peripheries. The thus wrapped towel roll (which includes the disc positioned on the upper surface of the towel roll) is then subjected to heat, as in a heated shrink tunnel, to cause the film to shrink down into tight engagement with the towel roll. In the drawings, 14.4 designates the heat sealed seams that may extend substantially about the body of the towel roll.

Any appropriate material may be employed for the wrapping, and a variety of flexible, heat-sealable polymeric materials are available for this purpose, including biaxially oriented polyester films, co-extruded films, and the like. Since, desirably, only a single thickness of the film is employed (as contrasted with a plurality of circumferentially extending wraps), it is desired to use a wrapping material that is sufficiently strong to perform its function in supporting and protecting the towel roll and restraining diametrical enlargement of the roll when subjected to axial compressive forces, while at the same time, for reasons of economy and weight, is reasonably thin. The film desirably is sufficiently thin as to enable it to be flexed with the fingers, but yet is sufficiently stiff as to at least substantially hold its shape as toweling within the wrapper is depleted.

Although shrink packaging is the preferred procedure, stretch packaging, using known materials and equipment, could also be used. The disk 16 is placed on the top surface 12.1 of the towel roll before the unit is wrapped.

Although the wrapper may engage the circumferential surface of the roll only snuggly enough to restrain the roll from significantly expanding in diameter when subjected to an axial load, it is preferred that the wrapper tightly engage the circumferential surface 12.3 of the towel roll, that is, that it actually squeeze the circumferential surface of the roll. The wrapper about the circumference of the roll strongly restrain the roll from significantly expanding in diameter when it is subjected to axial compressive loading of twice the weight of the towel roll product, as when a vertical stack is made of the towel roll products. In this manner, the circumferential wrapper tends to support and stabilize the roll. Moreover, although the wrapper extends in contact with the towel roll about the entire circumference of the roll, in a less desired embodiment the wrapper itself may be formed so as to have areas where it does not contact the entire outer cylindrical surface of the towel roll.

Figure 4:
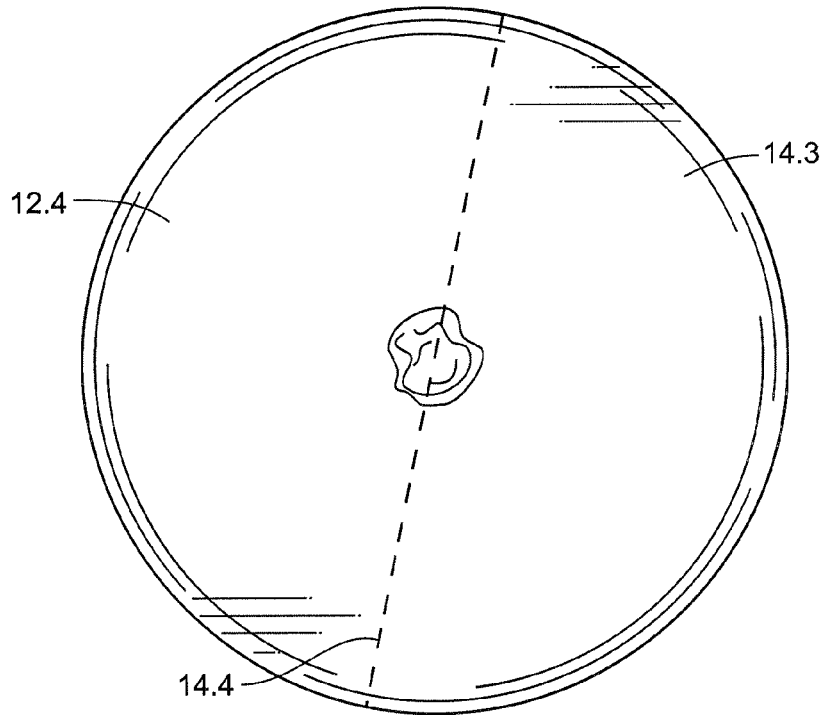
FIG. 4 is a bottom view of the towel roll product of FIG. 1.

Referring now to FIGS. 3 and 4, it has been noted that both the disk 16 and the top portion 14.3 of the wrapper have openings formed therein to permit one to reach through them with the fingers and grasp the toweling at the interior of the roll so that sections of toweling may be pulled axially through the openings. The openings in the wrapper and disk may be made after the wrapper has been applied to the towel roll as discussed above. Alternatively, the disk may have an opening 16.1 that is formed in the disk prior to the assembly of the disk onto the upper surface of the towel roll, and an opening may then be made in the upper portion 14.2 of the wrapper using the opening in the disk as a guide. Various other methods of forming the openings will be evident to those skilled in the art.

The disk desirably is circular in shape, as shown in the drawings, but may have other peripheral shapes as well. For example, the disk may be generally square, or may be hexagonal in shape, if desired. A circular shape which is coaxial with the generally cylindrical towel roll is preferred. The periphery 16.2 of the disk preferably extends to or nearly to the circumference of the towel roll, and it is preferred to have the periphery of the disk be coextensive with the circumference of the roll.

Referring particularly to FIG. 3, it will be noted that the opening 16.1 formed in the disk (and, for convenience, the opening formed in the wrapper) may have a shape in which two opposed edges of the opening are generally straight and parallel, and the other two opposed edges 16.2, 16.3 of the disc opening 16.1 are lobe shaped, the lobes extending generally inwardly toward each other for the purpose of engaging perforations in the toweling as the toweling is removed. In this manner, the phenomenon known as "roping," in which multiple towels are pulled from the towel roll without being separated from one another, is restrained or avoided. It may also be noted that the stiffness of the disk 16 tends to maintain the top surface of the roll in a generally flat configuration and promotes stability when the towel roll product is to be formed into a vertical stack for storage or display.

As thus described, the towel roll product of the invention is capable of dispensing sheets of clean toweling one sheet at a time as needed. The wrapper can be sealed after each use to maintain the towel roll free of contamination, and the product itself, because of the wrapper that is employed, is lightweight and cost effective. The wrapper, and a preferred embodiment, serves not only to protect the enclosed towel roll from moisture and contamination, but also serves to add to the axial stiffness of the towel roll product and maintains the cylindrical configuration of that product so that the products may be stably stacked one upon another.

In a preferred embodiment, the towel roll product described above may be employed in connection with the water-resistant container disclosed in U.S. patent application Ser. No. 10/870,329, published as Publication No. 20050046314. That publication discloses a water resistant container configured to receive a towel roll and to dispense the towels from an opening in the top of the container. The container itself may be made of a plastic material of sufficient rigidity as to maintain its shape, the container having an exterior handle that can be manually grasped. A container of this type is shown at 20 in FIGS. 5 and 6. The container has a generally flattened bottom 20.1 from which arise side walls 20.2, the latter desirably being generally cylindrical in shape and preferably having a substantially circular cross section. The upper end 20.3 of the container is open with the opening being desirably circular and sufficiently wide as to enable insertion of a towel roll product of the invention. A cover 20.4 covers the opening and serves as the top wall of the container.

Cover 20.4 has a skirt portion 20.5 that connects with the periphery of the opening defined by the walls of the container. The junction between the cover and the walls may be threaded, or, more desirably, the cover and rim of the opening may have cooperating, facing annular shoulders such that when the cover is pushed down upon the body of the container, the annular ridge of the cover slips over the confronting annular ridge of the opening, often with an audible "click."

Figure 5:
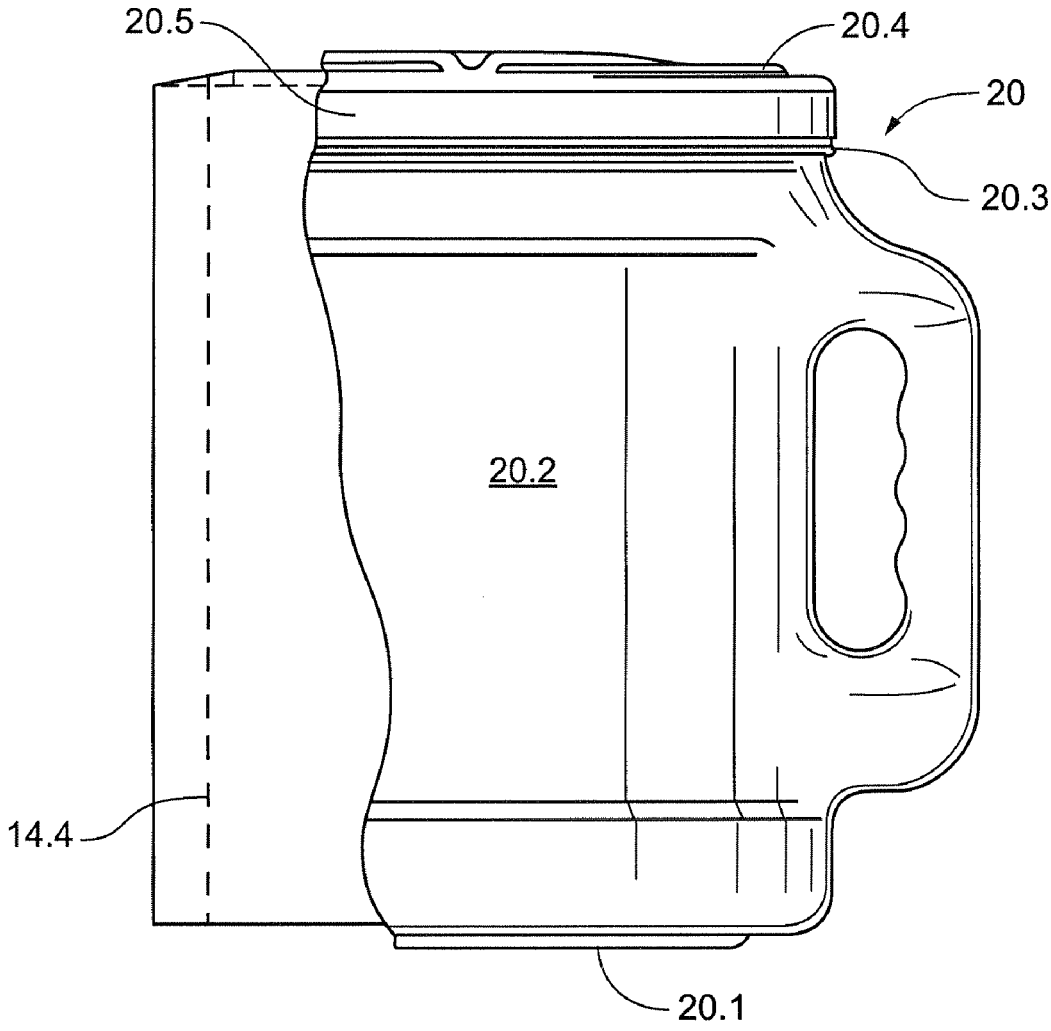
FIG. 5 is a broken away side view of a container bearing a towel roll product of the invention.
Figure 6:
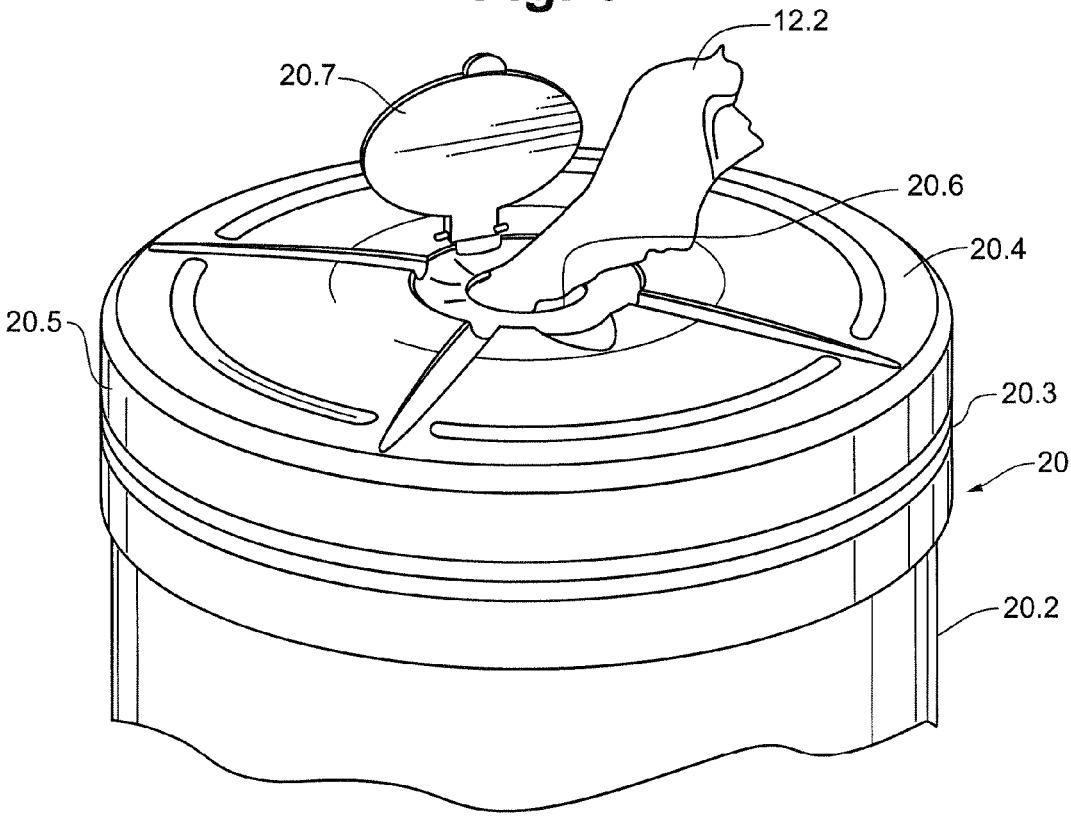
FIG. 6 is a broken-away perspective view of the container with towel roll product shown in FIG. 5.

Although the wall 20.2 of the container desirably is generally cylindrical in shape, it may have other configurations. For example, the walls of the container may, in cross section looking downwardly, describe a generally square configuration with desirably rounded edges. The cover 20.4 may be domed upwardly slightly, as shown in FIGS. 5 and 6, for the purpose of causing water or other contamination on the top of the container to flow outwardly and away from the center of the cover. In its center, the cover 20.4 has an opening 20.6, and the cover itself has a hinged lid 20.7, which, in its closed position, covers the opening 20.6.

The interior height of the container, that is, the height between the interior of the cover 20.4 and the floor of the container, is chosen to be approximately the same as the height of a towel roll product of the invention. The central domed portion of the cover may be spaced upwardly slightly from the upper surface of the towel roll product, but the domed upper surface of the cover is sufficiently flexible so that when a vertical force is applied downwardly on the cover (as when a series of the containers are stacked one upon another vertically, the interior of the cover will flex resiliently downwardly into contact with the upper surface of the towel roll product. In this manner, the towel roll product, held against diametrical expansion by the tightly encasing circumferential wrapper of the product, provides stability to the container/product combination.

When a towel roll product of the invention is inserted into the container shown in FIGS. 4 and 5, the cover 18 is peeled from the opening in the wrapper and disk to expose the roll of towels. The peel away cover 18 can then simply be discarded. The towel roll product is inserted into the container, and the cover of the container is fastened to the container opening as described above. Towels may then be drawn upwardly through the opening 20.6 in the container cover, the edges of the disc opening continuing to serve a function of separating the towels one from another as they are pulled from the roll.

Thus, the towel roll product of the invention, comprising a generally cylindrical towel roll and wrapper, can be used either as a separate, stand alone supply of toweling, or may be used as an insert for the container described above. In each case, the wrapper serves to support and protect the toweling within it. The circumferential surface of the towel roll product, when it is inserted in the container, may touch the interior walls of the container, or may be spaced slightly from these walls. The support provided by the peripheral wrapper continues to axially stiffen the towel roll product, and axially stiffens the combined product and container.

FIGS. 7 and 8 show another embodiment of the invention that is similar to that shown in FIGS. 1-6 but that includes a disc 16' having a periphery 16.1' that is coextensive with the outer circumferential surface of the towel roll 12'. It has been found that by having the disc thus extend to cover substantially the entire upper surface of the roll, the rigidity of the roll product is improved. As toweling is removed from the roll, less toweling remains in the roll to provide axial stiffness and to preserve the cylindrical shape of the product. This is of particular concern when the towel roll product is being used as a stand-alone product, that is, without being housed in a container 20. Utilization of a disc 16' that extends to the periphery of the roll has been found to aid substantially in preserving the axial strength and cylindrical shape of the towel roll product, and may have this effect even when only a few coils of toweling remain in the roll.

FIG. 7 shows the disc 16' having a generally circular opening 16.1' with diametrically opposed slots extending outwardly from the opening to define confronting lobes 16.2' on each side of the opening, the lobes being effective to engage individual sheets of toweling as the latter are withdrawn from the roll.

As shown also in FIGS. 7 and 8, the towel roll 12' desirably includes a sheet 22' positioned between the wrapper 14' and the circumferential surface 12.3' of the towel roll, the sheet conforming to the outer surface of the roll and extending circumferentially over a portion, desirably at least a major portion, of the outer cylindrical surface of the roll. FIG. 8 depicts the sheet as having ends 22.1', 22.2' that are circumferentially spaced slightly from each other, but the sheet may extend completely around the circumference of the roll if desired. When the wrapper 14' is transparent, as shown in FIGS. 7 and 8, the sheet may be in the form of a label with identifying indicia, advertising, etc. exemplified at 22.3' printed on it. The top and bottom edges 22.4', 22.5' of the sheet may be spaced from the top and bottom surfaces 12.1', 12.4' of the roll. The sheet thus offers further circumferential strength about the central portion of the roll, with the top and bottom portions of the roll being circumferentially strengthened by the top and bottom portions 14.2', 14.3' of the wrapper. In this manner, the sheet itself provides additional support for the roll in providing and preserving axial strength and cylindrical shape of the towel roll product when the latter is used as a stand-alone product.

While preferred embodiments of the present invention have been described, it should be understood that various changes, adaptations and modifications may be made therein without departing from the spirit of the invention.

The invention claimed is:

1. A generally cylindrical towel roll product comprising an absorbent towel roll having an upright axis, a circumferential outer surface and top and bottom surfaces, and a flexible, water resistant, protective wrapper engaging the circumferential surface of the towel roll about its entire circumference and of sufficient strength to restrain significant diametric expansion of the towel roll when the roll is subjected to an axial load and to increase axial stiffness of the product, the wrapper including top and bottom portions that encase the top and bottom surfaces of the roll, respectively, the top wrapper portion having an opening providing axial access to the towel roll and through which individual towels can be drawn axially from the interior of the towel roll, and a removable and replaceable soil and water-resistant cover protectively covering the wrapper opening, and a rigid disc positioned between the upper surface of the towel roll and the top wrapper portion, the disc having an opening aligned with the opening in the upper portion of the wrapper to enable access to toweling.

2. The towel roll product of claim 1 wherein the disc is substantially coextensive with the upper surface of the roll.

3. The towel roll product of claim 2 including a supportive sheet positioned between the circumferential surface of the roll and the wrapper and extending circumferentially of the roll.

4. The towel roll product of claim 3 wherein the wrapper is transparent, and wherein the sheet includes identifying indicia visible through the transparent wrapper.

5. The towel roll product of claim 3 wherein circumferentially extending top and bottom edges of the sheet are spaced from top and bottom surfaces of the roll, respectively.

6. The towel roll product of claim 2 wherein the disc includes confronting lobes positioned to encounter toweling as the toweling is withdrawn axially from the towel roll.

7. The towel roll product of claim 1 wherein the wrapper tightly engages the circumferential surface of the roll.

8. A toweling product comprising a protective, water-resistant container and the towel roll product of claim 1 housed therewithin, the container having bottom, top and side walls and a manually graspable exterior handle, the top of said container having an opening providing axial access to the towel roll.

9. The toweling product of claim 8 wherein the top of the container is spaced from the top surface of the towel roll, and is sufficiently flexible as to be resiliently urged downwardly into contact with the roll upon application of an axially directed force.

10. A towel product comprising an absorbent towel roll having an upright axis, a circumferential outer surface and top and bottom surfaces, and a flexible, water resistant, protective wrapper engaging the circumferential surface of the towel roll and of sufficient strength to restrain significant diametric expansion of the towel roll when the roll is subjected to an axial load of twice the weight of the product and to increase axial stiffness of the product, the wrapper including top and bottom portions that encase the top and bottom surfaces of the roll, respectively, the top wrapper portion having an opening providing axial access to the towel roll and through which individual towels can be drawn axially from the interior of the towel roll, a rigid disc positioned between the upper surface of the towel roll and the top wrapper portion, the disc having an opening aligned with the opening in the upper portion of the wrapper to enable access to toweling, and a protective, water-resistant container within which the towel roll is housed, the container having bottom, top and side walls and a manually graspable exterior handle, the top of said container having an opening providing axial access to the towel roll and a hinged lid providing axial access to the container opening.

11. The towel roll product of claim 10 wherein the disc extends radially to the periphery of the upper surface of the roll.

12. The towel roll product of claim 11 including a supportive sheet positioned between the circumferential surface of the roll and the wrapper and extending circumferentially of the roll.

13. The towel roll product of claim 12 wherein the wrapper is transparent, and wherein the sheet includes identifying indicia visible through the transparent wrapper.

14. The towel roll product of claim 12 wherein circumferentially extending top and bottom edges of the sheet are spaced from top and bottom surfaces of the roll, respectively.

15. A generally cylindrical towel roll product comprising an absorbent towel roll having an upright axis, a circumferential outer surface and top and bottom surfaces, a flexible, transparent, water resistant, protective wrapper tightly engaging the circumferential surface of the towel roll about its entire circumference and of sufficient strength to restrain significant diametric expansion of the towel roll when the roll is subjected to an axial load and to increase axial stiffness of the towel roll product, the wrapper including top and bottom portions that encase the top and bottom surfaces of the roll, respectively, the top wrapper portion having an opening providing axial access to the towel roll and through which individual towels can be drawn axially from the interior of the towel roll, a rigid disc positioned between the upper surface of the towel roll and the top wrapper portion, the disc having an opening aligned with the opening in the upper portion of the wrapper to enable access to toweling, the disc being substantially coextensive with the upper surface of the roll, and a removable and replaceable soil and water-resistant cover protectively covering the wrapper opening.

* * * * *